US009505465B2

(12) United States Patent
Wright et al.

(10) Patent No.: US 9,505,465 B2
(45) Date of Patent: Nov. 29, 2016

(54) APPARATUS AND METHOD FOR ATTACHING WATERCRAFT

(71) Applicant: FUNDAMENTAL CONSULTING SERVICES INC., Surrey (CA)

(72) Inventors: Glenn Warren Wright, Canada (CA); Darryn Ragnar Eyjolfson, Canada (CA)

(73) Assignee: FUNDAMENTAL CONSULTING SERVICES INC., Surrey, BC (CA)

( * ) Notice: Subject to any disclaimer, the term of this patent is extended or adjusted under 35 U.S.C. 154(b) by 0 days.

(21) Appl. No.: 14/570,896

(22) Filed: Dec. 15, 2014

(65) Prior Publication Data

US 2016/0167746 A1 Jun. 16, 2016

(51) Int. Cl.
*B63B 21/00* (2006.01)
*E02B 3/24* (2006.01)

(52) U.S. Cl.
CPC ..... *B63B 21/00* (2013.01); *B63B 2021/001* (2013.01); *B63B 2221/20* (2013.01)

(58) Field of Classification Search
CPC ..... B63B 21/00; B63B 2021/00; B63B 2021/001; B63B 2021/005; B63B 2021/20; B63B 2021/203
USPC ..... 114/230.1, 230.15, 230.17, 230.18, 114/230.2, 230.22, 230.24, 230.25, 230.26, 114/230.3
See application file for complete search history.

(56) References Cited

U.S. PATENT DOCUMENTS 3,224,404 A 12/1965 De Jong
3,406,651 A 10/1968 Jalbert
3,585,959 A * 6/1971 Cook ..... B63B 59/02 114/220
3,863,591 A * 2/1975 Wild ..... B63B 21/00 114/219

(Continued)

*Primary Examiner* — Daniel V Venne

(57) ABSTRACT

The present invention provides an apparatus for attaching a first watercraft to another structure such as another watercraft or a fixed structure. The apparatus comprises a spacing member and attachment members. The spacing member has two ends and outer edges that define a width of the spacing member. An attachment member is connected to each end of the spacing member at the outer edges. The attachment members are releasably attachable to the watercraft and the attachment members are freely rotatable about each end of the spacing member. Another example of the apparatus provides two spacing members, first and second attaching loops and a tension system. The first attaching loop extends from a first end of the two spacing members. The second attaching loop extends from a second end of the spacing members. The attaching loops are releasably attachable to the watercraft and it is freely rotatable about the ends of each of the spacing members.

18 Claims, 4 Drawing Sheets

(56) References Cited

U.S. PATENT DOCUMENTS

| | | | | | |
|---|---|---|---|---|---|
| 4,299,183 | A * | 11/1981 | Prock | E02B 3/24 | 114/218 |
| 4,708,083 | A * | 11/1987 | Billings | B63B 21/00 | 114/221 R |
| 4,751,892 | A | 6/1988 | Sechel et al. | | |
| 4,781,138 | A | 11/1988 | Hay | | |
| 5,046,442 | A * | 9/1991 | Hay | B63B 21/00 | 114/230.17 |
| 5,408,946 | A * | 4/1995 | Jones | B63B 21/00 | 114/230.1 |
| 5,499,591 | A | 3/1996 | Chippas | | |
| 5,634,421 | A | 6/1997 | Velarde | | |
| 5,676,085 | A * | 10/1997 | Michl, Jr. | B63B 21/00 | 114/230.1 |
| 6,431,104 | B1 | 8/2002 | Webb | | |
| 7,089,877 | B1 | 8/2006 | Hay | | |
| 7,100,527 | B2 | 9/2006 | Munro | | |
| 7,827,924 | B1 | 11/2010 | Perez | | |
| 8,091,499 | B1 | 1/2012 | Perez | | |
| 8,800,461 | B2 | 8/2014 | Gagan, II | | |
| 8,857,359 | B1 * | 10/2014 | Gonzalez | B63B 21/00 | 114/230.15 |
| 2007/0289518 | A1 * | 12/2007 | Lawson | B63B 21/00 | 114/230.27 |
| 2008/0196650 | A1 * | 8/2008 | Fernung | B63B 21/08 | 114/230.24 |

* cited by examiner

APPARATUS AND METHOD FOR ATTACHING WATERCRAFT

FIELD OF INVENTION

This disclosure generally relates to attaching watercraft for rafting or mooring. In particular, the disclosure relates to an apparatus and method for rafting one watercraft to another watercraft and mooring watercraft to a structure.

BACKGROUND

The use of watercraft, such as waterski boats, wakeboard boats, fishing boats and the like is of increasing popularity. Often times, users like to attach their watercraft to other watercraft for various purposes such, as socializing and meals, while floating on a body of water. Attaching one floating watercraft to another is referred to as rafting.

While the rafted-watercraft float on the body of water, they are subject to waves, the wakes of other boats, tides, and currents that can cause the rafted watercraft to move relative to each other. This relative movement increases the risk that the watercraft will contact each other and cause damage to one or both of the watercraft.

When moored to a fixed structure, such as a dock, wharf or pier, the watercraft are subject to the undulating surface of the water. The undulating of the watercraft, relative to the permanent structure, can cause the watercraft to contact the fixed structure, which may damage the watercraft.

U.S. Pat. No. 5,499,591 to Chippas teaches a mooring device for boats that can be used to moor one watercraft with another. The Chippas device requires an elongated arm with a hook at one end and a transverse slot at the other end. The hook is rotatable between an open and a closed position to engage a cleat on one boat. A locking mechanism is also provided that allows a cleat of another boat to be locked into the slot.

U.S. Pat. No. 5,634,421 to Velarde teaches a boat-mooring device that can be used to moor one watercraft to another. The Velarde apparatus is a tubular spacing device with a flexible line that extends through an interior channel of the device. The user can tie the flexible line into a loop at one end and secure it to a cleat on each of the two watercraft.

U.S. Pat. Nos. 7,827,924 and 8,091,499 both to Perez teach a boat-mooring device. The Perez devices both have a bar with integral clamps on each end. The integral clamps engage cleats on each of the two watercraft for mooring.

U.S. Pat. No. 8,800,461 to Gagan II teaches a boat-mooring device that is useful for separating moored watercraft having wakeboard racks. The Gagan II device has two cross members that can be tied or secured by bungee cords to the wakeboard racks of each boat. A boat extender element is connected to each cross member to distance the moored watercraft apart.

SUMMARY

Generally, the invention relates to attaching two or more watercraft to each other, such as during rafting. The invention also generally relates to attaching a watercraft to a fixed structure, such as a dock, wharf or pier.

Waves, currents, tides and other disturbances in the water can cause rafted watercraft to move relative to each other, including towards each other. Of particular concern are the waves caused by other watercraft because they can be out of phase with, and larger than, naturally occurring waves. During rafting, boaters often position bumpers, inflatable tubes or other padded or cushioned articles that are typically found on watercraft to act as a protective cushion between the watercraft. However, these protective measures are often inadequate and it remains common for rafted watercraft to contact and sometimes damage each other. The inadequacy of the typical protective measures and the damage caused is often accentuated if the two watercraft are not of a similar size.

The present invention also provides an apparatus and method of rafting two watercraft together that can accommodate the movement of each watercraft relative to the other while preventing the two watercraft from coming into contact. Furthermore, the present invention provides a way of quickly rafting watercraft together while avoiding any requirements to tie knots.

When attaching a watercraft to a permanent structure, boaters are often challenged by large pilings that position the dock well above the surface of the water and, therefore, above the height of their watercraft. Using a typical approach of ropes and bumpers may still leave the watercraft susceptible to damage caused by waves pushing the watercraft into the dock and the dock contacting the watercraft above the bumpers.

The present invention provides an apparatus and method of mooring watercraft to a permanent structure that accommodates the movement of the watercraft relative to the structure. For example, the apparatus maintains a predetermined distance between the dock and the watercraft while accommodating the movement of the watercraft on the water.

The present invention includes at least two examples. Some of the features of a first example are shown in FIG. 1. Some of the features of a second example are shown in FIGS. 2 to 4. At least some of the features depicted in FIGS. 2 to 4 may also be used with the first example.

As described further below, the present invention provides a first example apparatus for mooring a first watercraft with a second watercraft. The apparatus comprises a spacing member and a plurality of attachment members. The spacing member has a first end, a second end and two outer edges that define a width of the spacing member. At least one attachment member is connected to each end of the spacing member at each of the two outer edges. The attachment members are releasably attachable to the first watercraft at the first end and the second watercraft at the second end respectively. The attachment members are freely rotatable about each end of the spacing member.

The present invention also provides a second example apparatus for mooring a first watercraft with a second watercraft. This apparatus comprises at least two spacing members, a first and second attachment member and a tension system. Each of the at least two spacing members have a first end and a second end. The first attachment member is connected to and extends from the first end of each of the at least two spacing members. The first attachment member is releasably attachable to the first watercraft and freely rotatable about the first end of each of the at least two spacing members. The second attachment member is connected to and extends from the second end of each of the at least two spacing members. The second attachment member is releasably attachable to the second watercraft and freely rotatable about the second end of each of the at least two spacing members. The tension system generates a tensioning force that contributes towards maintaining the position of the at least two spacing members relative to each other.

Both of the first and second example apparatuses can be used to moor a watercraft to a permanent structure. All that is required is to secure the attachment members of one end to the permanent structure, such as a dock, and the attachment members of the other end to the watercraft.

The present invention addresses some shortcomings of the prior art including a requirement that a user is proficient in tying knots to secure the mooring devices to the watercraft. The present invention maintains a predetermined spacing between two floating watercraft while compensating for at least some of the individual movement of each of the floating watercraft. In reference to the first example apparatus, the width of the spacing member may prevent a bow or stern of one watercraft from contacting the other watercraft. The distance between the spacing members of the second example apparatus may also prevent the bow or stern of one watercraft from contacting the other watercraft. The freely rotatably attachments can compensate for at least some of the relative movement of each floating watercraft without reducing, interfering with or impinging upon the predetermined spacing between the two floating watercraft The present invention also allows one user to assemble the apparatus, connect one side of the apparatus to their watercraft and present the other side of the apparatus to a second user in another watercraft without the requirement of tying any knots.

BRIEF DESCRIPTION OF DRAWINGS

Various examples of the apparatus are described in detail below, with reference to the accompanying drawings. The drawings may not be to scale and some features or elements of the depicted examples may purposely be embellished for clarity. Similar reference numbers within the drawings refer to similar or identical elements. The drawings are provided only as examples and, therefore, the drawings should be considered merely illustrative of the present invention and its various aspects, embodiments and options. The drawings should not be considered limiting or restrictive as to the scope of the invention.

DETAILED DESCRIPTION

The present invention provides an apparatus for attaching a watercraft to another structure. The other structure may be another watercraft, for example during rafting, or the other structure may be a fixed structure that is fixed to the earth, either permanently or not, within a body of water, for example a dock, wharf or pier. The apparatus comprises a spacing member and a plurality of attachment members. The spacing member has opposite first and second ends and a width that is defined by two outer edges. Optionally, the width of the spacing member is adjustable so that each outer edge can be aligned with connectors on the other structure. The attachment members are releasably attachable to the first watercraft at the first end of the spacing member and the other structure at the second end of the spacing member, respectively. The attachment members are freely rotatable, through all degrees of freedom, between the spacing member and the respective watercraft.

Figure 1:
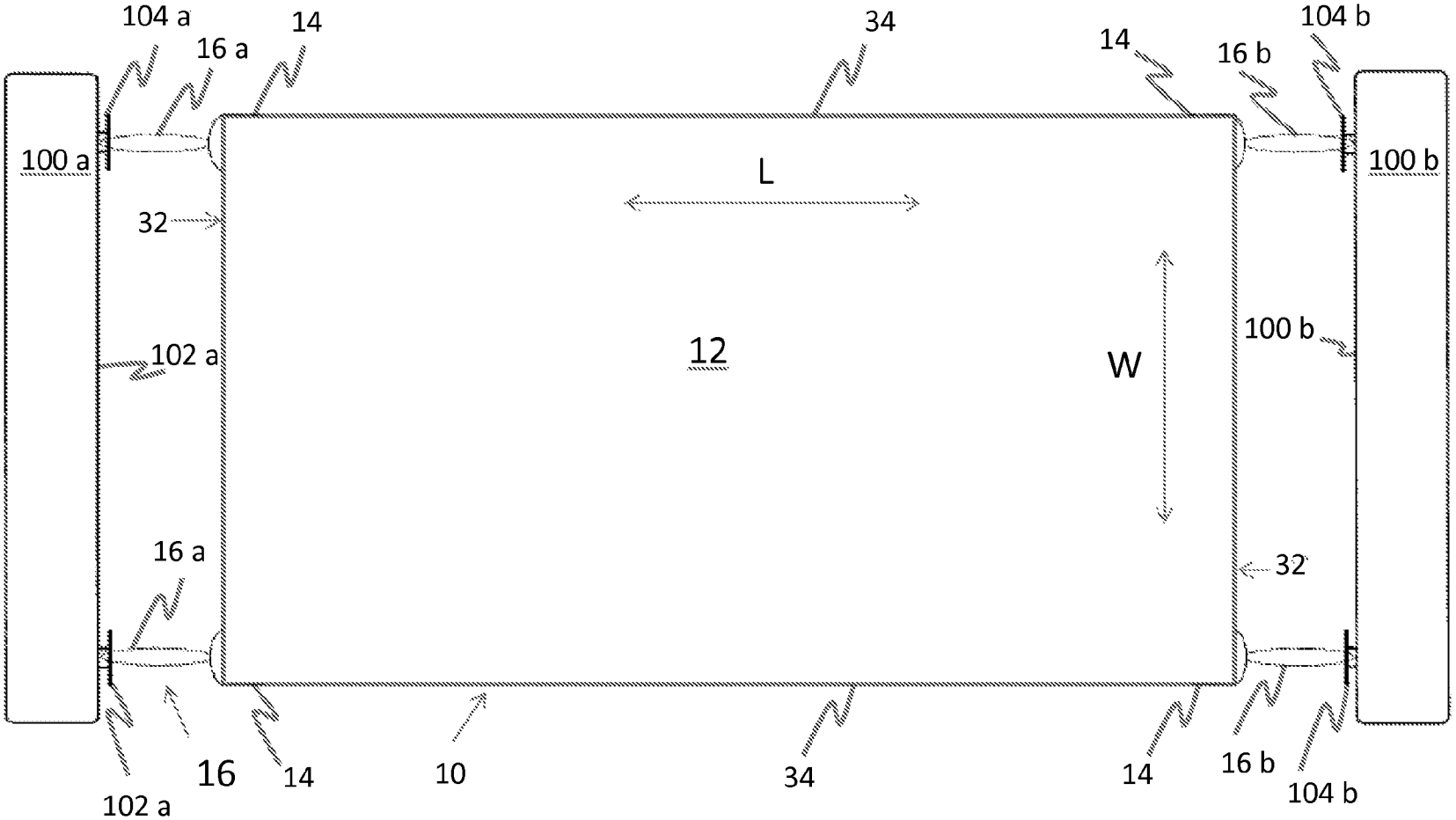
FIG. 1 is a top plan view of an example of an apparatus for mooring two watercraft together.

FIG. 1 depicts one example of a boat mooring apparatus 10 for mooring a first watercraft 100*a* with a second structure 100*b*. For example the second structure 100*b* may be another watercraft or a fixed structure such as a dock, a wharf or a pier. The apparatus 10 comprises a spacing member 12 and a plurality of attachment members 16, illustrated by way of example as members 16*a* and 16*b*. The spacing member 12 has two opposite ends 32 that define a length "L" of the spacing member 12 therebetween. The spacing member 12 has two outer edges 34 that define a width "W" of the spacing member 12 therebetween. The spacing member 12 may for example, as illustrated, be a rigid sheet, although this is not intended to be limiting. The rigid sheet may or may not be longer than it is wide.

Figure 2:
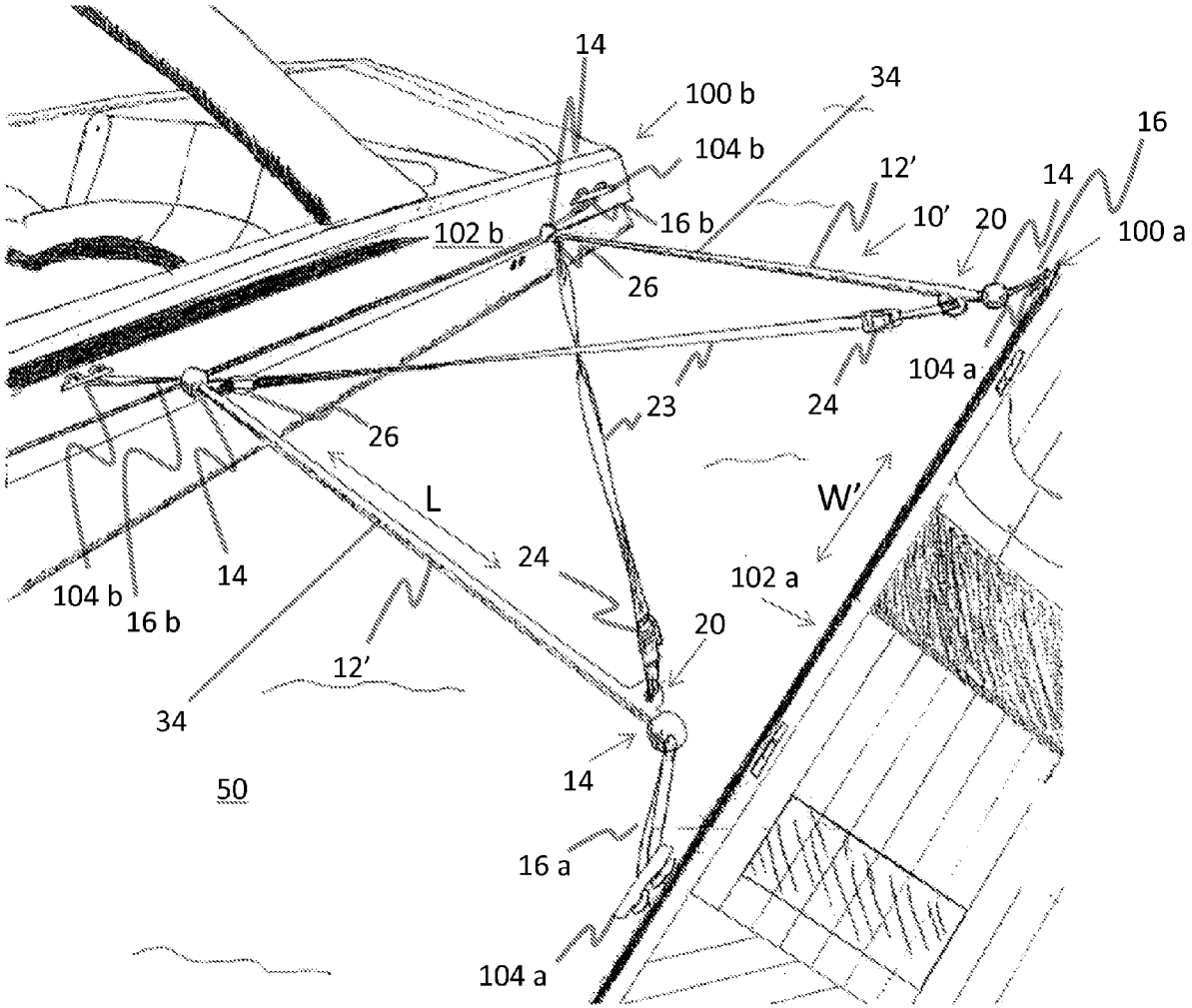
FIG. 2 is a perspective view of a further example of an apparatus for mooring two watercraft together.

FIG. 2 depicts a second example of a boat mooring apparatus 10' that comprises at least two elongate spacing members 12' in the form of a first member and a second member. Each spacing member 12' has an attachment member 16 connected at each of its opposite ends 32. While FIG. 1 depicts one spacing member 12 and FIG. 2 depicts two spacing members 12', this is not intended to be limiting as one, two or more spacing members will also work.

The spacing members 12, 12' are substantially rigid which allows the spacing members 12, 12' to maintain a minimum, or predetermined, distance between the first watercraft 100*a* and the second structure 100*b*. The spacing members 12, 12' are made of a substantially rigid material so that the distance between the two ends 32 does not vary while the apparatus is in use. For example, the spacing members 12, 12' can be made of wood, rigid polymers, rigid resins, metals, metal alloys, rigid polyvinyl chloride, rolled metal-sheets, fiberglass or combinations and composites of these, or other rigid materials which provide the separating function. Depending upon the forces generated by one of the rafted watercraft 100*a, b* as it moves relative to the other watercraft, the spacing member 12, 12' may flex or bend. Such resiliency may be advantageous to help, for example, absorb any shock loading as such flexing or bending will be temporary for resilient material of appropriate strength and will not appreciably change the length of the spacing member 12, 12'.

The length of the spacing member 12, 12' defines the predetermined distance between the moored watercraft 100*a, b*. In one example, the spacing members 12, 12' has a length in a range between about 100 cm and about 160 cm. Optionally, the spacing members 12, 12' may have an adjustable length, such as with a telescopic arrangement and a locking mechanism that, when engaged, maintains the length of the spacing members 12, 12' while in use. When the lock mechanism is disengaged, a user can retract the spacing members 12, 12' to facilitate storage.

As stated above and as depicted in FIG. 1, the outer edges 34 of the spacing member 12 are spaced apart to define a width W of the spacing member 12. When the spacing member 12, 12' is mounted between watercraft 100*a* and the second structure 100*b*, the width W, W' overlaps with, i.e. it is juxtaposed along, a mid-portion of the length of the watercraft 100*a*. The outer edges 34 may be spaced apart at such a distance that the attachment members 16 can attach to the watercraft 100*a* and the second structure 100*b* at positions that help prevent contact between the watercraft 100*a* and the second structure 100*b* if there is relative movement between the first watercraft 100*a* and the second structure 100*b*. For example, the outer edges 34 of the spacing member 12 may substantially align with one or more cleats 104*a, b* on the respective watercraft 100*a* and the second structure 100*b*. The cleats 104*a, b* are typically fixed to a sidewall of the hull or upper decking of the 100*a* and the second structure 100*b*, typically near, or on, the gunwale. However, the cleats 104*a, b* may be positioned in different positions depending upon the manufacture of the watercraft 100*a* and the second structure 100*b*.

Because the distance between the cleats 104*a, b* can vary among different watercraft, such that the width W of the spacing member 12, is substantially equal to the width the distance W' between the first and second spacing members 12'. In this case, the width W of the spacing member 12 can be adjusted, as would be understood by those skilled in the art, so that the outer edges of the spacing member 12 can substantially align with the cleats 104*a, b*.

Figure 3:
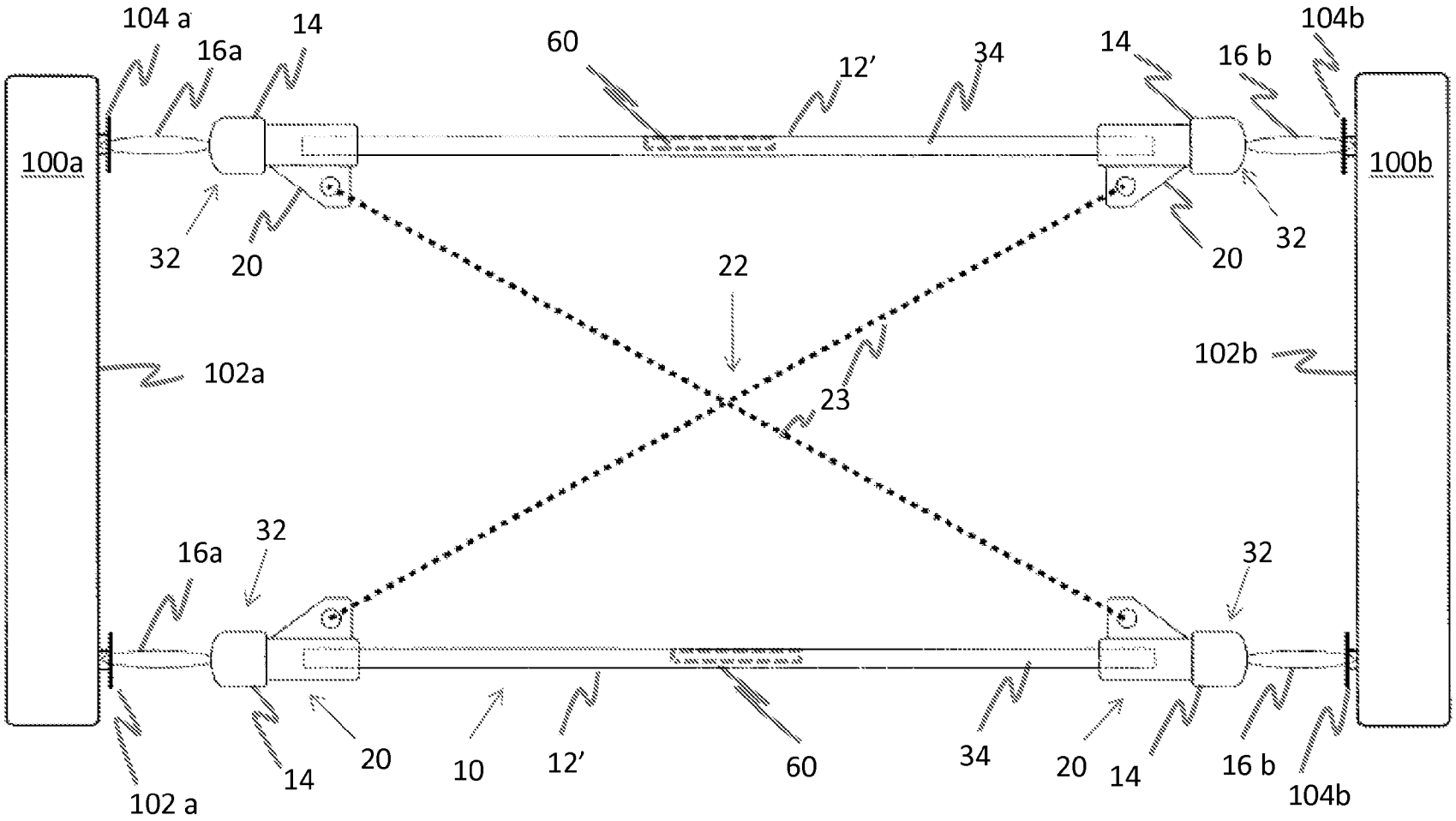
FIG. 3 is a top plan view of the apparatus of FIG. 2.
Figure 4:
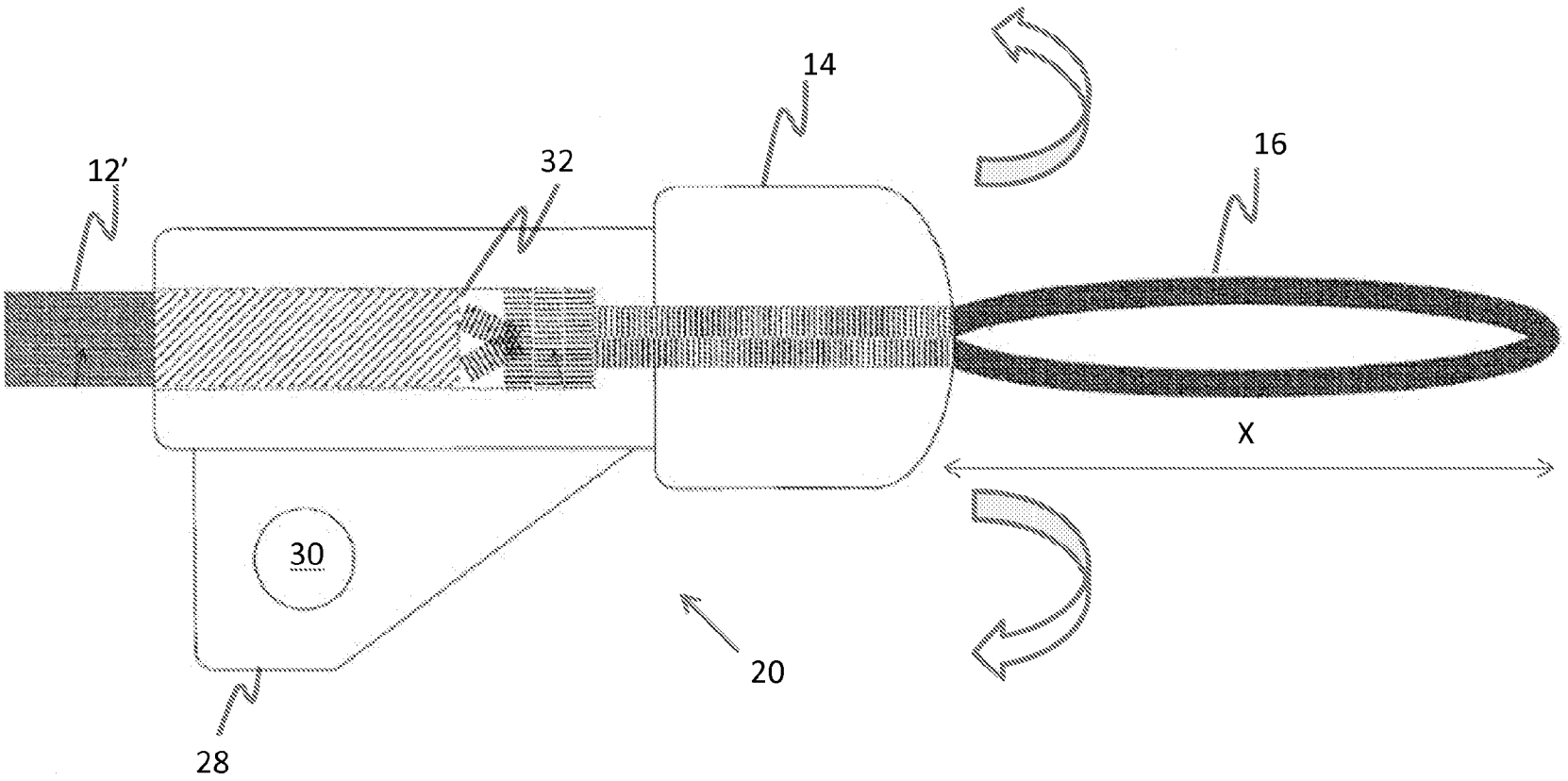
FIG. 4 is a side elevation, partial cut-away view of an example of a connector for use with the apparatus of FIG. 2.

FIGS. 2 to 4 depict the second example of a boat mooring apparatus 10'. In apparatus 10', the spacing member collectively refers to two substantially parallel, elongate spacing members 12' and the two outer edges 34 coincide with their respective spacing members 12'. In other examples of the boat mooring apparatus 10', there may be more than two spacing members 12'.

In both examples of the boat mooring apparatuses 10, 10', the attachment members 16 are releasably attachable to the watercraft 100*a, b*. In the example of FIG. 1, the attachment members 16 are connected to the ends 32 of the spacing members 12, near to or at each outer edge 34. In the example of FIG. 2, the attachment members 16 are connected to ends 32 of spacing members 12'. FIG. 4 depicts one example of the attachment members 16 that are fixed within a connector 20 that is connected at each end 32 of the spacing members 12'. The attachment members 16 are each formed as a loop that is attachable to the cleats 104*a, b* on the first watercraft 100*a* and the second structure 100*b*. The attachment members 16 are able to rotate freely about the ends 32 of the spacing member 12.

The attachment members 16 can be a flexible cord, webbing, string or rope that is made from a braided or woven fabric. The fabric can be natural, such as cotton and flax, or synthetic, such as nylon, polyester or polypropylene. In another example, the attachment members 16 can be a solid flexible body or a hollow flexible body that is formed by an extrusion process or otherwise.

The phrases "freely rotate" and "freely rotatable" are used herein as a reference to the ability of the end of the attachment members 16 that is not connected to the spacing member 12, 12' to rotate in all degrees of freedom about the point of connection with the spacing member 12, 12' (see arrows in FIG. 4). This free rotation may be caused by and compensate for some independent movement of the watercraft 100*a* relative to watercraft 100*b*, and vice versa. For example, if the watercraft 100*a, b* moves vertically, such as caused by a wave, the attachment member 16 will rotate accordingly. Similarly, if the watercraft 100*a, b* moves horizontally, for example, in response to a current in the body of water, the attachment member 16 will rotate accordingly. This free rotation of the attachment members 16 may compensate for at least some of the forces that are exerted on the cleats 104*a, b* when the watercraft 100*a, b* move relative to each other.

The adjustable width W of the spacing member 12 and the adjustable distance W' between the spacing members 12' allows the attachment members 16 to be a desired length. The length of the attachment members 16 refers to the length of the loop formed by the attachment members 16 (see dimension line X in FIG. 4). In one example, the attachment members 16 can be a length in a range of about 50 mm to about 250 mm. In another example, the attachment members 16 can be a length in a range of about 75 mm to about 200 mm. Preferably, the attachment members 16 are about 150 mm long. If the attachment members are too long, the ends 32 may be able to move with too great a degree of freedom. For example, the ends 32 could rise above the gunwale and injure a passenger as the watercraft buck and/or yaw. Alternatively if the attachment members 16 are too short then they will not be able to compensate for the relative movement of the watercraft 100*a, b*. This may lead to undesirable loads being imposed upon the cleats 104*a, b* and the points where the attachment members 16 connect to the spacing members 12, 12'.

In another example of the boat mooring device 10, 10 the spacing member 12, 12' can also include bumpers 14 that are positioned at or near the ends 32 to absorb some or all of the impact of either of the watercraft 100*a, b* contacting the spacing member 12, 12'. The bumpers 14 may be elastomeric bodies and that are made from various materials that have viscous and elastic properties such as, for example: unsaturated rubbers, saturated rubbers and thermoplastic elastomers. In one example, the bumpers 14 are made from polyethylene foam.

As depicted in FIGS. 2 and 3, the boat mooring apparatus 10' further includes a connector 20 and a tension system 22.

The connector 20 is fixed to each end 32 of the spacing member 12'. The connector 20 has a tubular portion with a hollow channel that fits over the end 32 of the spacing member 12'. The connecter 20 can be fixed to the ends 32 by at least one of adhesive, sonic welding, friction fit and additional connectors such as pins or wraps. Optionally, the connector 20 can be manufactured to be integral with the ends 32 so that the spacing member 12' is of a monolithic construction that includes the connecter 20 at each end 32. A portion of the attachment member 16 can also be housed within the hollow channel of the connector 20. For example, during manufacturing of the boat-mooring device 10, the attachment member 16 may be passed through the hollow channel to form the loop and a knot can hold the attachment member 16 within the connector 20. The bumper 14 may also have a hollow channel to accommodate the attachment member 16 passing therethrough.

The bumper 14 may be positioned adjacent to the tubular portion of the connector 20. The bumper 14 may be an integral part of the connector 20, or not. Preferably, the bumper 14 is not integral with the connector 20 but the bumper 14 is connected to one end of the connector 20. This preferred arrangement permits the bumper 14 and the connector 20 to be constructed of different materials. As described above, the bumper 14 can be constructed from various materials that have viscous and elastic properties. The connector 20 can be constructed from more rigid materials than the bumper 14. For example, the connector 20 may also include an extension 28 with an inner edge that defines an aperture 30 therethrough. The aperture 30 can receive a tension connector 26 of the tension system 22. The connector 20 is made from materials that are sufficiently rigid to withstand the forces exerted by the tension system 22 on the inner edge of the extension 28 that defines the aperture 30.

The tension system 22 provides an adjustable tension force between the two spacing members 12'. In the example depicted in FIGS. 2 and 3, the tension system 22 comprises two tension straps 23 and two tensioning members 24. Each tension strap 23 is connected at one end to each end 32 of the spacing members 12'. The tension straps 23 cross over each other at a midway point so as to form an x-shape. In one example of the tension system 22, the tension straps 23 are connected to the connector 20 via a tension connector 26. The tension connector 26 can be stitched or sewn, a hook, a maillon, a carabineer or other type of connector that does not require the user to tie a knot to attach the tension straps 23 to the spacing members 12'. In one example, the tension connector 26 is selectively releasable, although this is not intended to be limiting.

The tension straps 23 can be a cord, webbing, string or rope that is made from a braided or woven fabric. The fabric can be natural, such as cotton and flax, or synthetic, such as nylon, polyester or polypropylene. The tensioning members 24 can selectively adjust the tension across the tension straps 23. For example, the tension members 24 can be fasteners, linking devices, tie downs, cam buckles or ratchets that can increase or decrease the tension across the tension straps 23.

Optionally, the spacing members 12, 12' may further include a float 60 (shown by hashed lines in FIG. 3) that is made from a buoyant material, such as polyethylene foam. The float 60 prevents the boat mooring apparatus 10, 10' from sinking in the body of water 50 if it is dropped.

In operation, a first user 110*a* of one watercraft 100*a* attaches the attachment members 16 to the cleats 104*a*. The first user 110*a* holds the rest of the boat mooring apparatus 10, 10' above the surface of the body of water 50. When used for rafting, the other watercraft 100*b* is positioned alongside the watercraft 100*a*. The first user can move, for example lower or raise, the distal end of the boat mooring apparatus 10, 10' so that a second user 110*b* in the other watercraft 100*b* can receive the attachment members 16 that are opposite to those attached to watercraft 100*a*. The second user can then attach the attachment members 16 to cleats 104*b* so as to complete the rafting together of the two watercraft. When used for mooring the first watercraft 100*a* to a fixed structure, such as a dock, wharf or pier, the distal end of the apparatus 10 is lowered so that the corresponding attachment members 16 may be mounted to the cleats (or other mooring fixture) on the fixed structure. Thus the first watercraft 100*a* and the second water craft (during rafting) or the fixed structure (during mooring) are attached together at a predetermined space apart from each other.

When using the boat mooring apparatus 10', and when all of the attachment members 16 are attached, a further step of generating tension in tension straps 23 may be taken by whichever user is closest to the tension members 24. That user can actuate the tension member 24 to increase the tension across the tension straps 23 until the desired tension to produce a rigidly cross-braced frame is achieved to produce the desired rafting or mooring.

While the above disclosure describes certain examples and options of the present invention, various further modifications to the described examples and options will also be apparent to those skilled in the art. The scope of the claims should not be limited by the examples and options provided above; rather, the scope of the claims should be given the broadest interpretation that is consistent with the disclosure as a whole.

What is claimed is:

1. A mooring apparatus comprising:

a. a spacing member with first and second opposite ends and two outer edges that define a width therebetween; and b. a plurality of attachment members, with at least one attachment member attached to each of the first and second opposite ends of the spacing member at each of the two outer edges, wherein the plurality of attachment members are releasably attachable to a first watercraft at the first end of the spacing member and a second watercraft at the second end of the spacing member respectively, and wherein the attachment members are freely rotatable about each of the first and second opposite ends of the spacing member;

wherein a distance between the first end and the second end define a predetermined spacing distance.

2. The apparatus of claim 1, wherein the width of the spacing member is adjustable.

3. The apparatus of claim 1, wherein the length of the spacing member is adjustable.

4. The apparatus of claim 1, wherein the spacing member comprises a first spacing member and a second spacing member, wherein the first and second spacing members are separated by a distance that is substantially equal to the width.

5. The apparatus of claim 4, wherein the spacing member further comprises a tension system comprising two tension straps and two tensioning members that connects a first end of the first spacing member with a second end of the second spacing member for generating a first tension force therebetween and the tension system connects a second end of the first spacing member with a first end of the second spacing member for generating a second tension force therebetween to cross-brace the first and second spacing members.

6. The apparatus of claim 5, wherein the first and second tension forces are adjustable.

7. The apparatus of claim 1, wherein the spacing member further comprises bumpers positioned at each of the first and second opposite ends at each outer edge.

8. The apparatus of claim 1, wherein the plurality of attachment members are flexible.

9. The apparatus of claim 1, wherein the spacing member further comprises a float member.

10. An apparatus for attaching a first watercraft with a second structure, the apparatus comprising:

a. at least two spacing members, each spacing member with a first end and a second end;

b. a first attachment member that is connected to and extends from the first end of each of the at least two spacing members, the first attachment member is releasably attachable to the first watercraft and the first attachment member is freely rotatable about the first end of each of the at least two spacing members;

c. a second attachment member that is connected to and extends from the second end of each of the at least two spacing members, the second attachment member is releasably attachable to the second structure and the second attachment member is freely rotatable about the second end of each of the at least two spacing members;

d. a tension system comprising two tension straps and two tensioning members that is connected between the first end of one of the at least two spacing members and the second end of another of the at least two spacing members, the tension system provides adjustable tension between the at least two spacing members.

11. The apparatus of claim 10, wherein the at least two spacing members further comprise a bumper positioned at the first end and the second end.

12. The apparatus of claim 10, wherein one of the at least two spacing members further comprises a float member.

13. The apparatus of claim 10, wherein the first attachment member and the second attachment member are flexible.

14. A method of using the apparatus of claim 1 comprising steps of:

a. attaching the first watercraft to the attachment members at the first end of the spacing member; and b. attaching the second watercraft to the attachment members at the second end of the spacing member.

15. A method of using of the apparatus of claim 10 comprising steps of:

a. attaching the first watercraft to the attachment members at the first end of the spacing member; and b. attaching the second structure to the attachment members at the second end of the spacing member.

16. The method of claim 15, further comprising a step of adjusting a tension between the at least two spacing members.

17. The method of claim 15, wherein the second structure is a second water craft.

18. The method of claim 15, wherein the second structure is a fixed structure.

* * * * *